United States Patent [19]

Reiser et al.

[11] Patent Number: 4,931,011

[45] Date of Patent: Jun. 5, 1990

[54] CONTROL AND METHOD FOR OPERATING A VAPORIZER BURNER

[75] Inventors: Peter Reiser; Erich Kenner, both of Esslingen, Fed. Rep. of Germany

[73] Assignee: J. Eberspächer, Esslingen, Fed. Rep. of Germany

[21] Appl. No.: 321,959

[22] Filed: Mar. 10, 1989

[30] Foreign Application Priority Data

Apr. 13, 1988 [DE] Fed. Rep. of Germany ..... 3812299

[51] Int. Cl.[5] ..... F23N 5/00; F23Q 7/12

[52] U.S. Cl. ..... 431/3; 431/29; 431/28; 431/254; 431/262; 431/263

[58] Field of Search ..... 431/3, 29, 28, 254, 431/262, 263

[56] References Cited

U.S. PATENT DOCUMENTS 4,035,135 7/1977 Jacobsz ..... 431/29

*Primary Examiner*—Randall L. Green

*Attorney, Agent, or Firm*—McGlew & Tuttle

[57] ABSTRACT

Formerly unpleasant blue smoke was generated in a vaporizer burner for auxiliary heaters for motor vehicles once the fuel supply was cut off and the flame died down, as the remaining fuel was merely heated up, but not burnt. According to the invention the glow plug is activated for a determined period of time during the after-running phase of the combustion air blower. By this means practically all remaining fuel is vaporized and burnt and therefore the forming of blue smoke and remaining residues in the area of the plug muff and/or the burner is avoided.

4 Claims, 2 Drawing Sheets

CONTROL AND METHOD FOR OPERATING A VAPORIZER BURNER

FIELD OF THE INVENTION

This invention relates, in general, to burners and in particular to a new and useful operational method and control for a vaporizer burner.

The invention relates particularly to a vaporizer burner, such as used for a space heater used in a motor vehicle when the motor is not running. Such a space heater includes a combustion air blower, a fuel dosing pump supplying a vaporizing fuel, e.g. containing a fiber packet, surrounding a glow plug at least partially and which serves for the starting of the burner. The vaporizing fuel burns with the combustion air in its vaporized state. Furthermore, the invention relates to a process for the operation of a motor-independent vaporizer burner fed with liquid fuel, e.g. an auxiliary heater for a motor vehicle, wherein for the starting of a vaporizer burner a glow plug for the ignition of a fuel-air mixture in a combustion chamber of the burner is under a current flow for a certain period of time.

Vaporizer burners of the above kind are mainly used in heaters for motor vehicles, i.e. as auxiliary heaters for buses, trucks and also for automobiles.

BACKGROUND OF THE INVENTION

The invention relates to vaporizer burners in general, not only to those used in auxiliary heaters, but also e.g. for soot filter burners used for the elimination of soot residues. However, in the following, reference is made in particular to the subject of auxiliary heaters to illustrate the invention.

Especially in motor-independent auxiliary heaters running on liquid fuel for motor vehicles there are various kinds of heaters, e.g. burners operating with a pressure atomizer or a rotation atomizer. And there are vaporizer burners, in which the fuel is not atomized but vaporized for the generation of a fuel-air mixture. All the various burner types have certain advantages and disadvantages. In vaporizer burners the fuel is supplied to a vaporizer arrangement in a burner combustion chamber by means of a fuel dosing pump. This vaporizer arrangement comprises e.g. a kind of fiber packet or net, which fills out an area in the proximity of the glow plug for the starting of the burner. The fuel coming from the dosing pump is received by the fiber packet and reaches the flame area of a combustion chamber by means of capillary action. In order to initiate the combustion process, the glow plug is connected to a current source for a certain period of time. Furthermore, air is blown into the combustion chamber by means of combustion air blower. Basically the activation of the glow plug, the supplying of combustion air and the dosing of fuel can be started at the same time, usually, however, the pre-glowing takes place during the combustion air supply, and then the fuel is added. Due to the glow plug the vaporized fuel reaches the ignition temperature at the presence of air, so that the combustion process is started. After this starting process the glow plug is switched off.

It has been found that after the switching off of such vaporizer burners and during a later new starting of the heater blue smoke is generated. The after-exhaustion after the switching off of the vaporizer burner is the result of the extinguishing of the flame as the fuel supply is cut off, then the fuel remaining in the vaporizer arrangement is merely heated up, possibly while being supplied with combustion air during the usual after-running of the combustion air blower. Upon cutting the fuel supply a certain amount of fuel remains in the fiber packet of the vaporizer, and a part of it is turned into smoke once the flame is extinguished.

During the next start of the heater, especially during the pre-glowing and simultaneous supply of combustion air the fuel remainder in the fibre packet from the previous combustion process turns into smoke before new fuel is supplied and the fuel-air mixture is ignited.

The generation of blue smoke is undesirable with regard to the environment. A further disadvantage is that residues form in the area of the glow plug and the combustion chamber, which in time will impair the proper operation of the heater.

SUMMARY OF THE INVENTION

The invention provides a vaporizer burner which substantially eliminates the development of smoke after the switching off of the burner and/or during re-igniting, and wherein the residue built-up in the burner arrangement is prevented to the largest extent.

According to the invention, an after-glowing control is used to switch the glow plug on for a predetermined period of time once the fuel dosing pump has been stopped. The after-glowing control can be realized by means of a microprocessor, which also takes over other control functions.

In a process according to the invention the glow plug is ignited for a predetermined period of time once the vaporizer burner is switched off. The switching on of the glow plug can be effected simultaneously with the switching off of the burner, preferably once the fuel supply is closed. The switching on of the glow plug can also be effected by the switching off process of the vaporizer burner.

Usually vaporizer burners are operated so that after the fuel supply is closed the combustion air blower still runs for a certain period of time in order to keep the combustion process going until the flame dies due to too poor a mixture.

The disadvantages of vaporizer burners described above are avoided to a very large extent eliminated in the subject of the invention. Therefore, vaporizer burners are as effective as e.g. burners with rotation atomizer or pressure atomizer.

As the glow plug is switched on once the burner is stopped, the temperature of the remaining fuel in the area of the plug connection, and possibly also in the combustion chamber, is raised so far that the remaining fuel burns practically without residues. In comparison to known vaporizer burners the flame dies much later, as the glow plug supports the vaporization of the fuel and guarantees a sufficiently high temperature of the vaporized fuel. Thus a sufficiently rich fuel-air mixture is generated.

The fuel remaining, once the fuel supply has been cut off, is practically burned completely. Therefore the development of blue smoke is not only avoided after the switching off of the burner, but also when the device is switched on again at a later time, as no fuel is left over from a former combustion cycle.

As the remaining fuel is practically burnt completely once the burner is switched off, no remaining residues occur in the area of the plug muff and/or the combustion chamber.

Accordingly, it is an object of the invention to provide a vaporizer burner which has a combustion chamber with a glow plug fitting communicating with the chamber and which has a glow plug surrounded by a housing and fibrous material in the housing which communicates with the combustion chamber and which includes means for heating the plug and for supplying combustion air to the combustion chamber which permits the heating of the glow plug after switching off of the fuel and also the supplying of combustion air to the combustion chamber so as to burn away the fuel remaining in the fibrous material of the glow plug.

A further object of the invention is to provide a method of operating a vaporizing burner which is effective to insure the burning away of any blue smoke from the vaporizer after shut-off.

A further object of the invention is to provide a vaporizer burner control which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENT

Figure 2:
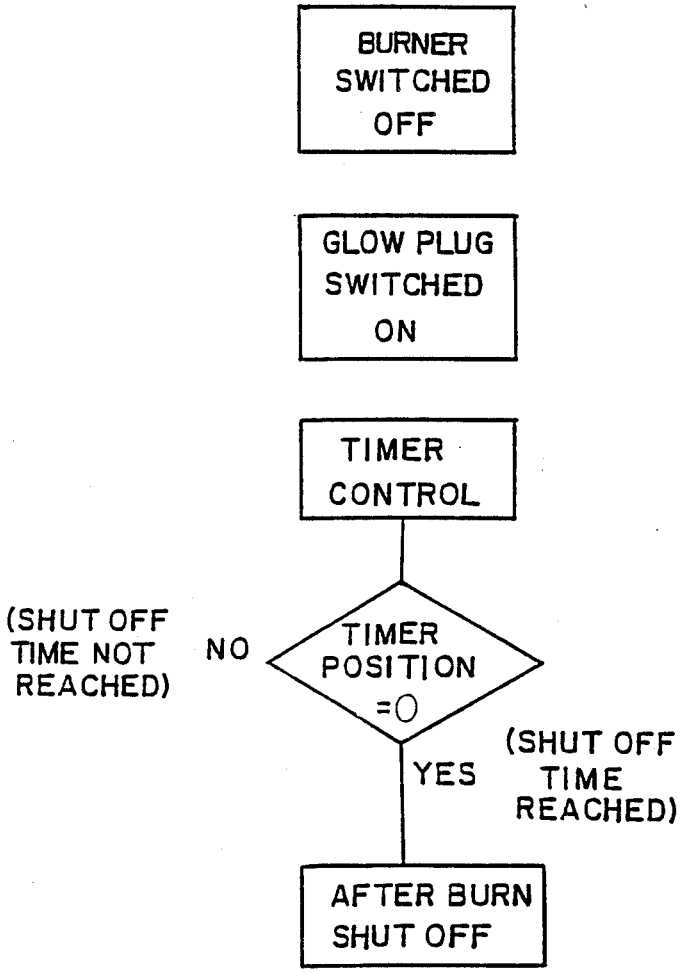
FIG. 2 is a flow chart with an example of the process according to the invention.

Referring to the drawings, in particular, the invention embodied therein comprises a vaporizer burner having a housing 1 with a combustion chamber 2 and with a glow plug fitting 3 extending into the combustion chamber and having a glow plug 31 surrounded by a cylindrical housing 33 with fibrous material 34 arranged in the housing between the glow plug and the interior of the housing and having an end in communication with the combustion chamber 2. Heating means represented schematically by the terminal connections 37 and the resistance wire around the plug heat the plug 31 to a high temperature. Construction includes means B for supplying fuel under pressure to an inlet 30 connected into the housing 33 for saturating the fibrous material 34 therein. In accordance with the invention, a control 50 is connected to the heating or glow plug power supply terminal means 37 and a fuel supply means 52 for supplying fuel B as well as to a combustion air supply 545, which supplies air VL into the combustion chamber 2. These control means effect a continued heating of the glow plug for a predetermined period of time after the fuel dosing pump of the fuel supply means B is shut off or de-activated.

Figure 1:
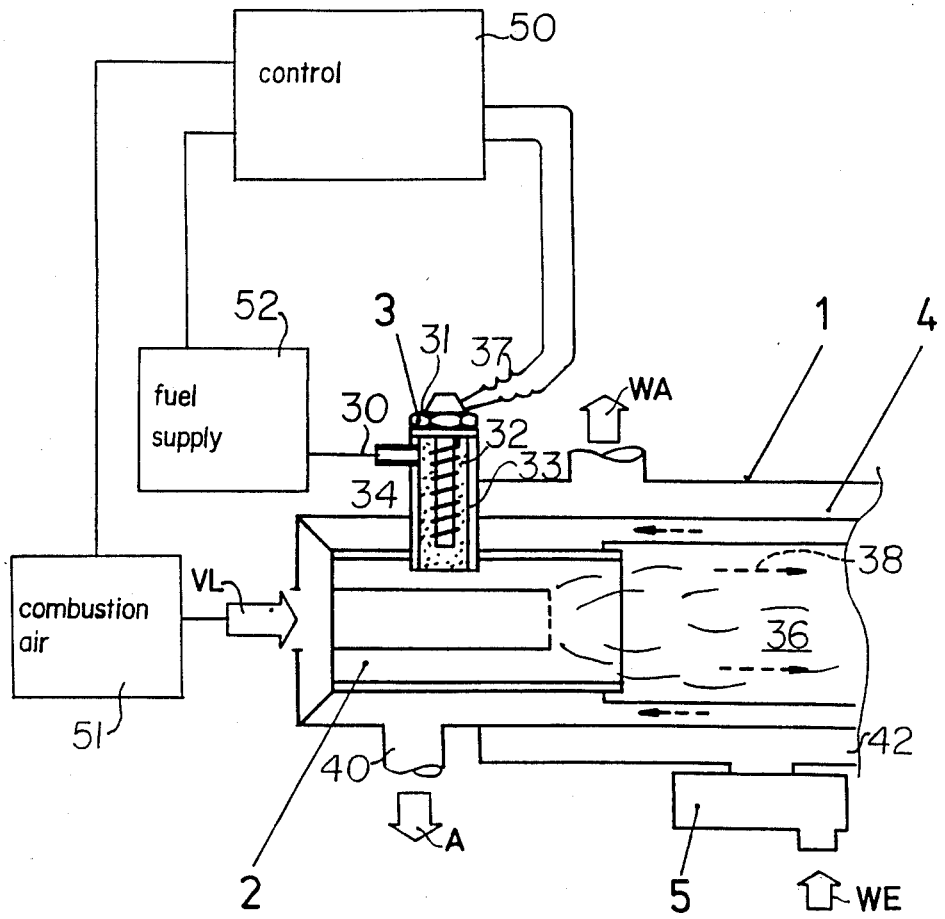
FIG. 1 is a diagrammatical partial view of a vaporizer burner constructed in accordance with the invention.

As shown schematically in FIG. 1, an auxiliary heating device for a motor vehicle comprises a housing 1 with a combustion chamber 2 inside the housing, which is supplied e.g. from the front with combustion air VL by means of a combustion air supply 54 (such as an air blower). In the combustion chamber 2 the combustion air is mixed with vaporized fuel.

The fuel pump B is supplied by means of the fuel supply 52 (such as a dosing pump) through a fuel inlet 30 in the direction of the arrow B. The inlet 30 coming from the fuel dosing pump opens into the vicinity of a glow plug 3. The glow plug 3 is mounted in a plug muff or fitting 32 having a net structure or a fibre packet 34 which can extend into the area of the combustion chamber 2. The fuel B entering in the vicinity of the plug muff 3 is received by the fibre packet 34 and reaches the combustion chamber 2 by means of capillary action, the fuel vaporizing on the inner surface of the plug muff and the combustion chamber. The vaporized fuel mixes with the combustion air VL In order to start the vaporizer burner the glow plug 3 is supplied with current for a predetermined time, so that it has a relatively high temperature sufficient for an ignition of the fuel-air mixture in the combustion chamber. The flame and the hot exhaust fumes enter the interior 36 of the housing (shown only partially) in the direction of the broken line arrows 38. The gases are then diverted at the end of the device (not shown) and reach an exhaust pipe 40 as exhaust fumes A adjacent the combustion chamber 2.

On the described path the hot exhaust fumes heat water circulated through a heat exchanger portion 4. The water enters an inlet of a water pump 5 as cold water which flows in the direction of the arrow WE and is pumped approximately helically through a ring chamber 42 of the heat exchanger 4 between an inner housing wall and an outer housing wall by means of the water pump 5, before it exits heated up at the arrow WA. From there the heated water enters e.g. a heater which is arranged at a convenient place of the vehicle.

For the starting of the heating device the combustion air blower and the glow plug 3 are switched on. After a pre-glowing phase fuel is supplied by activating the fuel dosing pump, so that the fuel-air mixture is quickly vaporized. When a certain set temperature is reached (this is determined by means of a sensor and control arrangement), the fuel supply is shut off by switching off the fuel dosing pump. The combustion air blower (defined schematically by the arrow VL designating combustion air circulation) still works during an after-running phase. The glow plug 3 is switched on upon the shutting off of the burner, i.e. when the fuel dosing pump is switched off. By this means the remaining fuel is heated up inside the plug muff and the combustion chamber 2, and its vaporization is promoted. Therefore the burner runs for a while until eventually all of the remaining fuel in the plug muff is vaporized and burned. Only then does the fuel-combustion-air mixture become so poor that the flame dies.

This process is shown schematically in FIG. 2. In step S1 the burner is switched off, in step S2 the glow plug 3 is switched on. Then a meter in a control (e.g. in the shape of a microprocessor) is set on a certain meter setting, and it starts to count backward. In step S4 it is checked whether the setting "0" has been reached already. If it has, the after-burning phase is closed. Therefore the glow plug is switched off in step S5. The air blower is switched off also.

At this stage practically all of the remaining fuel is burnt inside the burner. Therefore, there will be no development of blue smoke whenever the burner is switched on again at a later time. Only when fresh fuel is vaporized will the ignition of the fuel-air mixture take place.

While specific embodiments of the invention have been shown and described in detail to illustrate the application of the principles of the invention, it will be understood that the invention may be embodied otherwise without departing from such principles.

What is claimed is:

1. A method of operating a motor vehicle vaporizer burner which has a combustion chamber with a glow plug fitting extending into the combustion chamber and which includes a glow plug in a housing having fibrous material therein and which comprises supplying fuel to the housing of the glow plug to saturate the fibrous material around the glow plug, supplying combustion air to the combustion chamber and supplying current to the glow plug for a predetermined period of time to attain a temperature to effect burning of the fuel in the combustion chamber, sensing the discontinuance of the supply of fuel to the glow plug, again supplying the glow plug with current for a second predetermined period of time to burn off any residual fuel while continuing to supply combustion air to the combustion chamber.

2. A vaporizer burner for use in vehicles, comprising means defining a combustion chamber positionable within a vehicle; a glow plug fitting connected with said combustion chamber including a glow plug; a glow plug housing positioned about said glow plug; fibrous material positioned in said glow plug housing in contact with said glow plug and communicating with said combustion chamber; power terminal means connected to said glow plug for supplying power to said glow plug for heating said glow plug; fuel supply means for supplying fuel to said glow plug fitting; combustion air supply means for supplying combustion air to said combustion chamber; and control means connected to each of said fuel supply means, said power terminal means and said combustion air supply means for sensing a deactivation of said fuel supply means and for controlling said glow plug to heat said glow plug for a predetermined period of time after said sensed deactivation of said fuel supply means.

3. A vaporizer burner for vehicles according to claim 2, wherein said control means includes a microprocessor including a clock for measuring said predetermined period of time.

4. A vaporizer burner for vehicles according to claim 2, wherein said control means controls said combustion air supply means to maintain a combustion air supply during said predetermined period of time.

* * * * *